United States Patent [19]

Oury et al.

[11] Patent Number: 4,822,210

[45] Date of Patent: Apr. 18, 1989

[54] CONCRETE FINISHING MACHINE

[75] Inventors: Robert F. Oury, Gilberts; Charles J. Arndt, Bloomingdale, both of Ill.

[73] Assignee: Rotec Industries, Elmhurst, Ill.

[21] Appl. No.: 190,900

[22] Filed: May 6, 1988

Related U.S. Application Data

[63] Continuation of Ser. No. 917,406, Oct. 10, 1986, abandoned.

[51] Int. Cl.[4] ..... E01C 19/12

[52] U.S. Cl. ..... 404/106; 404/119

[58] Field of Search ..... 404/101, 106, 110, 116, 404/119, 96, 114

[56] References Cited

U.S. PATENT DOCUMENTS

| | | | |
|---|---|---|---|
| 2,292,733 | 8/1942 | Baily | 404/116 |
| 2,449,710 | 9/1948 | Miller et al. | 404/101 |
| 3,156,170 | 11/1964 | Behrens et al. | 404/101 |
| 3,221,618 | 12/1965 | Hudis | 404/101 |
| 3,540,359 | 11/1970 | Swisher et al. | 404/110 |
| 3,738,763 | 6/1973 | Glesmann | 404/119 |
| 4,256,415 | 3/1981 | Rowe et al. | 404/116 |
| 4,572,704 | 2/1986 | Allen | 404/119 X |
| 4,710,054 | 12/1987 | Allen | 404/110 |

FOREIGN PATENT DOCUMENTS

| | | | |
|---|---|---|---|
| 1256315 | 12/1971 | United Kingdom | 404/119 |

*Primary Examiner*—Jerome W. Massie, II
*Assistant Examiner*—Matthew Smith
*Attorney, Agent, or Firm*—Allegretti & Witcoff, Ltd.

[57] ABSTRACT

A concrete finishing machine having a movable framework mounted transversely over a paved area and defining an axis. A carriage is movably attached to the framework and has means for moving the carriage along the length of the framework. The carriage carries at least one rotating auger unit having leading and trailing portions mounted on one shaft and a finishing member. The auger unit has a leading portion having a helically arranged blade with an outer edge that is positioned in a fixed, spaced relationship with a desired grade. The trailing portion has a helically arranged blade with a band attached thereto to spread forward the excess concrete left by the leading portion and to finish the concrete at the desired grade. Plunging concrete vibrators are placed adjacent the auger unit leading portions. Means for conveying concrete, aligned with the framework axis, is mounted on the framework and has a side discharge station, movably mounted on the conveyor, for directing concrete from the conveying means to the paving area along the framework length. The side discharge stations has a plow, discharge chute and operator platform to centrally control all machine operations. The framework has track engaging end sections for support. Adjustment means are mounted on the end sections to maintain a desired grade for the concrete finishing operations during skewed movement of the framework axis relative to an axis perpendicular to the direction of framework travel.

26 Claims, 6 Drawing Sheets

FIG. 13
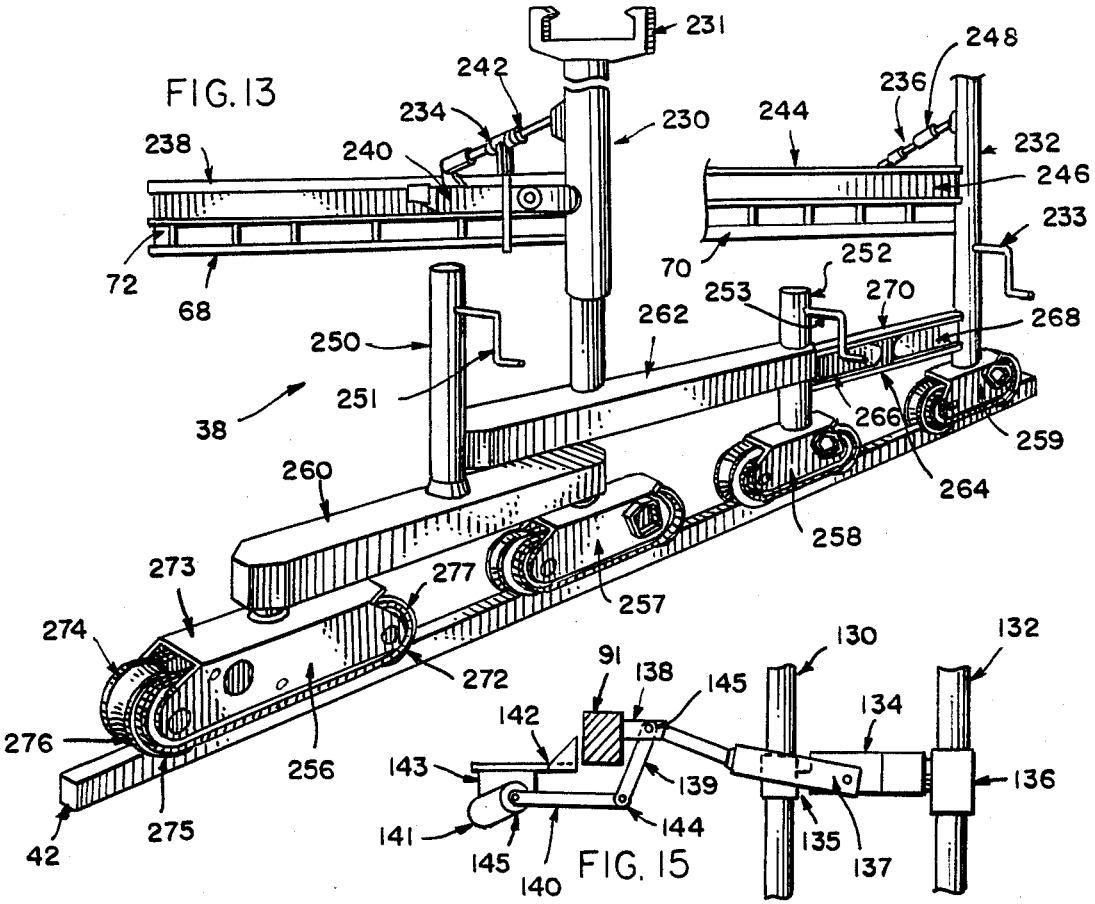
FIG. 15
FIG. 14
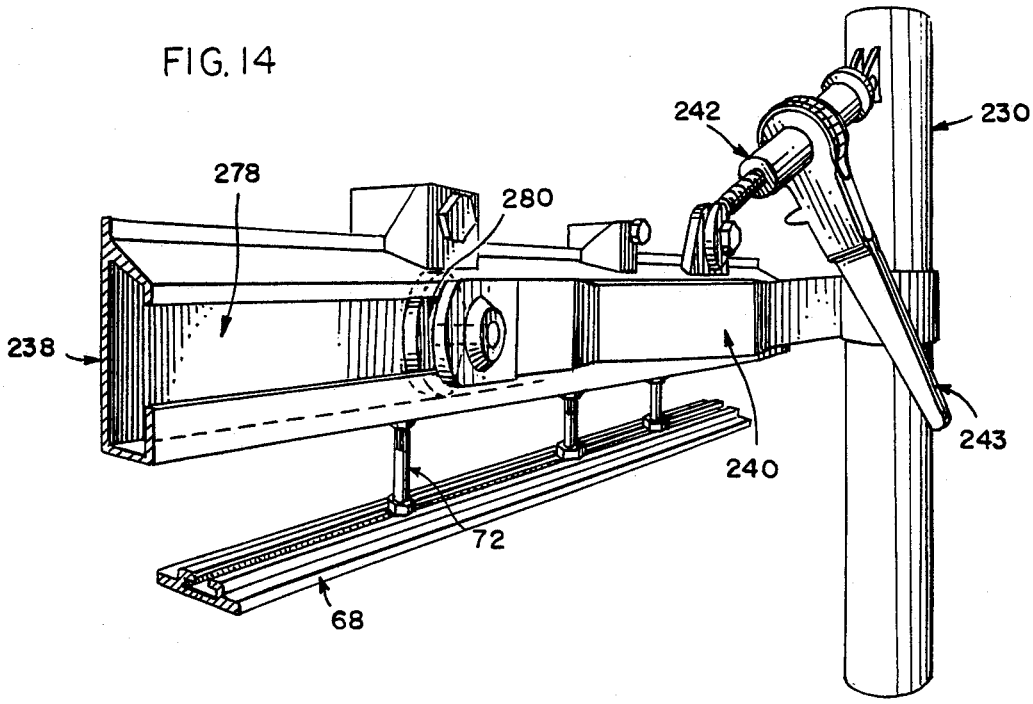

CONCRETE FINISHING MACHINE

This application is a continuation of application Ser. No. 917,406, filed on Oct. 10, 1986, now abandoned.

BACKGROUND OF THE INVENTION

This invention relates to a concrete finishing machine.

The typical method of placing and finishing concrete involves using separate apparatuses for placing concrete over a paving area and for finishing the concrete surface of the paving area at a desired grade. The paving area could be a road, parking lot, airport runway, bridgeway or the like.

Generally, the concrete is discharged onto the paving area from a spreader, pumping boom arrangement or the like at a considerable distance ahead of the concrete finishing machine. Several men with shovels then manipulate the concrete to evenly distribute the concrete for the concrete finishing machine.

The concrete finishing machine follows and extends transversely of the paving area to be paved with concrete. The machine generally consists of a truss spanning the paving area and a finishing carriage movably attached to the truss for movement along the length of the truss. The finishing carriage carries a rotating auger for positioning the concrete to approximate grade and moving excess concrete forward in the direction of machine travel, a rotating cylinder for consolidating and finishing the concrete to grade, and a float pan or drag plate for sealing the concrete surface. The finishing carriage moves in one direction until it reaches the side of the paving area and then reverses direction and travels to the opposite side of the paving area.

Various approaches have been suggested with respect to apparatus for placing and finishing concrete as set forth in the disclosure of the following patents:

| Reg. No. | Inventor | Title |
|---|---|---|
| 1,629,276 | Kipp | Concrete Pavement Finishing Machine |
| 1,878,278 | Jaeger | Road Or Pavement Making Apparatus |
| 1,993,656 | Gardiner | Method And Apparatus For Building Roads |
| 3,107,592 | Mengel | Machine For Spreading Concrete and Other Road Materials |
| 3,156,170 | Behrens | Placing Plastic Paving Material |
| 3,187,879 | Mengel | Spreader |
| 3,225,668 | Marginniss | Method And Apparatus For Distributing Concrete |
| 3,252,390 | Martinson | Concrete Paving Machine |
| 3,450,011 | Godbersen | Concrete Finishing Machine |
| 3,541,931 | Godbersen | Cement Finishing Mechanism Having Adjustable Rotating Drum |
| 3,767,312 | Raymond | Apparatus For Making Concrete Slabs |
| 4,466,757 | Allen | Vibrating Screed Including A Spreading Device For Leveling And Distributing Plastic Concrete In Front of the Screed |

The practice of placing and/or finishing concrete as described above and disclosed in the above-listed patents presents many shortcomings. The concrete placing operation is generally labor intensive, sometimes requiring seven or eight men to evenly distribute the concrete.

It is also difficult to gauge by visual estimation the proper amount of concrete being placed for the final grade when placement occurs at a distance ahead of the concrete finishing operation. Oftentimes, too much or too little concrete is initially placed. If too much is placed, then the finishing machine and laborers must move large quantities of concrete around the paving area. If too little is placed, then the laborers must place additional concrete at the finishing machine.

Moreover, as the distance and time between the placing and finishing operations increase, problems may develop relative to closing and sealing the concrete because the concrete may have cured significantly before it undergoes the finishing operation. This problem is especially prevalent under circumstances in which the concrete finishing machine is taken out of service unexpectantly for a period of time during the finishing operation.

Previous rotating cylinders on the moving carriage have generally not been completely satisfactory. The rotating cylinders move the excess concrete to either side of the paving area or can spill concrete onto the paving area that has already been finished by the rotating cylinders. Either situation is unsatisfactory because the excess concrete should be plowed forward in the direction of machine travel to fill voids that may exist.

Also, many of the prior art constructions are not suited for maintaining the proper grade when the truss axis is skewed relative to an axis that is substantially perpendicular to the direction of finishing machine travel and are not suited to handle high volumes and rates of concrete placement and finishing. The present invention overcomes such prior art shortcomings.

SUMMARY OF THE INVENTION

Briefly, the present invention relates to a concrete finishing machine for placing and finishing concrete over a paving area at high rates and with reduced manpower requirements. The concrete finishing machine has a framework mounted transversely over a paving area to be paved with concrete. The framework defines an axis substantially perpendicular to the direction of framework travel and has track engaging end sections to support the framework. Each end section has slidable connections connecting the end section to the framework and an alignment member mounted on the end section to maintain the desired grade of the paving area during skewed movement of the framework axis relative to an axis perpendicular to the direction of framework travel.

A carriage is movably attached to the framework for movement along the length of the framework. The carriage carries at least one rotating auger unit and a finishing member.

The auger unit has leading and trailing portions on an axis substantially aligned with the direction of framework travel. A concrete vibrator is mounted adjacent the leading portion. The leading portion has a helically arranged blade for plowing excess concrete forward in the direction of framework travel. The trailing portion has a helically arranged blade with a continuous band attached to the outer edge for contacting the concrete surface at a desired grade. The trailing portion plows the excess concrete forward and assists in finishing off the concrete. Thus, the auger unit solves the problem of concrete being pushed to the sides of the paving area by rotating cylinders.

The finishing member has a horizontal surface for engaging and finishing the concrete surface at a desired grade. The finishing member is positioned adjacent to the trailing portion of the auger unit in a following relationship relative to the direction of framework travel. If two parallel auger units are used, the finishing member has means for alternately moving the finishing members between first and second positions. The first position is aligned along the axis defined by a first auger unit; the second position is aligned along the axis defined by a second auger unit.

Concrete conveying means is mounted on the framework and substantially aligned with the framework axis. The conveying means has a side discharge station movably mounted on the conveyor for directing concrete from the conveyor to the paving area along the length of the conveyor in a fixed spaced relationship with the leading portion of the auger unit. The side discharge station has a plow for directing the concrete, a discharge chute for directing the concrete onto the paving area, means for moving the station along the length of the conveyor, and an operator platform for carrying an operator of the concrete finishing machine.

The operator centrally controls all operations of the concrete finishing machine. The operator also can direct the deposition of concrete onto the paving area by moving his feet which are mounted in stirrups attached to a flexible portion of the discharge chute of the conveying means.

Thus, it is an object of the present invention to provide a concrete finishing machine for placing and finishing concrete with increased capacity and reduced manpower requirements.

It is a further object of the invention to provide a concrete finishing machine that can maintain the desired grade during skewed movement of the framework axis relative to an axis perpendicular to the direction of framework travel.

Still a further object of the invention is to provide a concrete finishing machine that reduces the time and distance between the concrete placing operation and concrete finishing operation of a paving area to be paved.

Another object of the invention is to provide a concrete finishing machine that enables one operator to centrally control the operations of the concrete placement and concrete finishing of a paving area to be paved.

Yet a further object of the invention is to provide a concrete finishing machine that consolidates the concrete through vibration at the point of concrete placement onto the paving area.

A further object of the invention is to provide a concrete finishing machine that plows excess concrete forward in the direction of framework travel to fill voids that may exist.

Still a further object of the present invention is to provide a simplified, efficient and reliable construction for a concrete finishing machine.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 13 is an enlarged side view of the end sections of the invention;

FIG. 14 is an enlarged detail of the slidable connections connecting the end sections to the framework; and FIG. 15 is a detail of the mechanism for plunging the carriage vibrators in and out of the concrete surface.

DESCRIPTION OF THE PREFERRED EMBODIMENT

General Description

Figure 2:
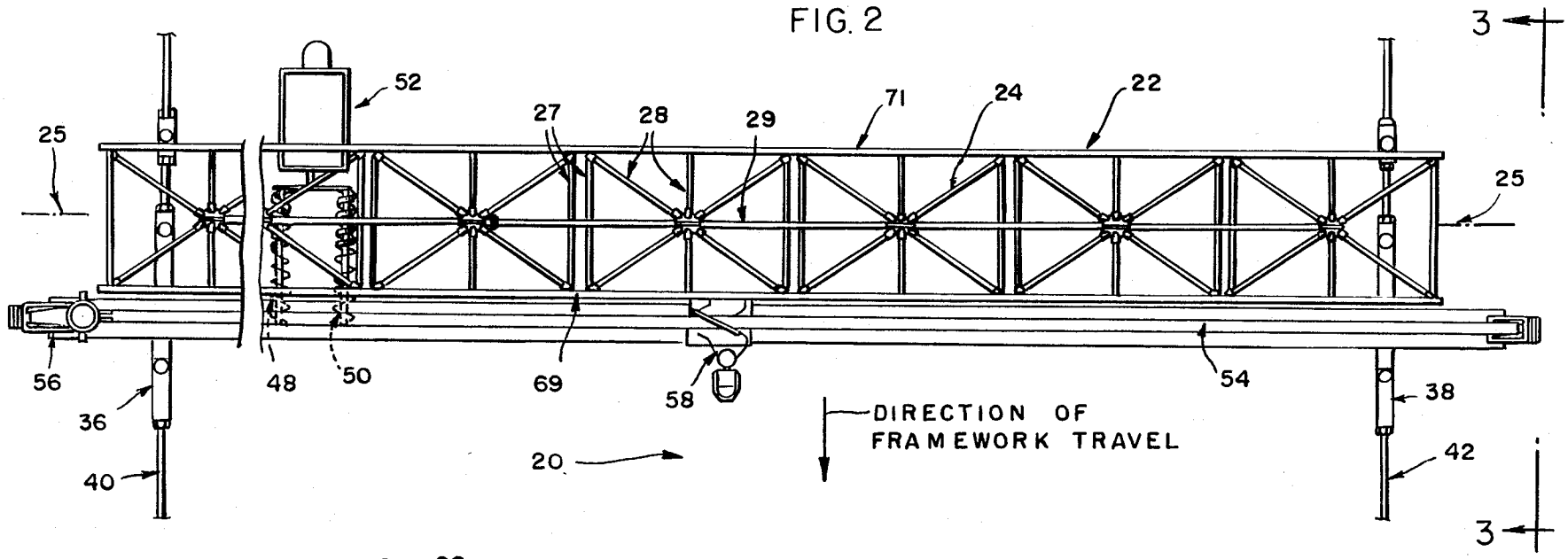
FIG. 2 is a top plan view of the concrete finishing machine of the invention.
Figure 1:
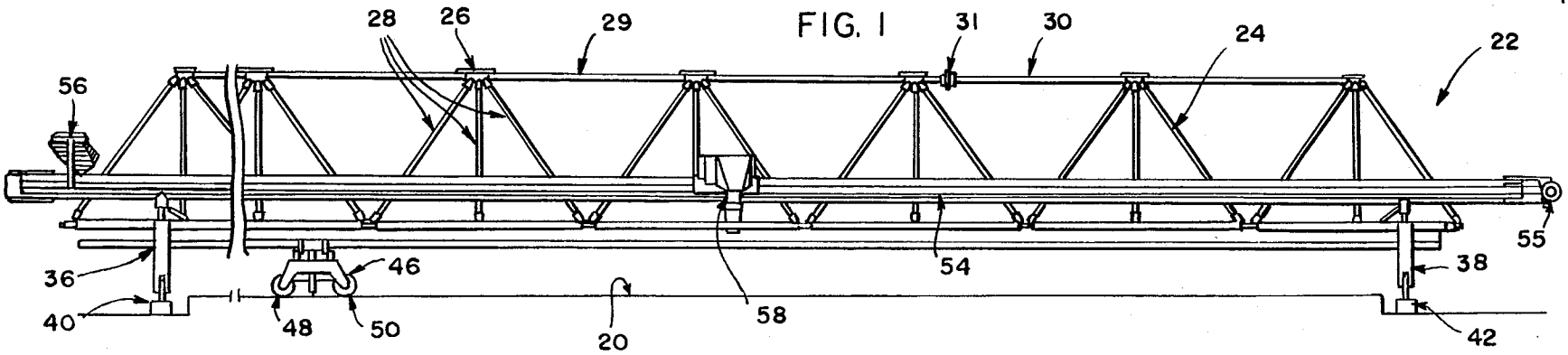
FIG. 1 is a side elevation of the concrete finishing machine of the invention.
Figure 3:
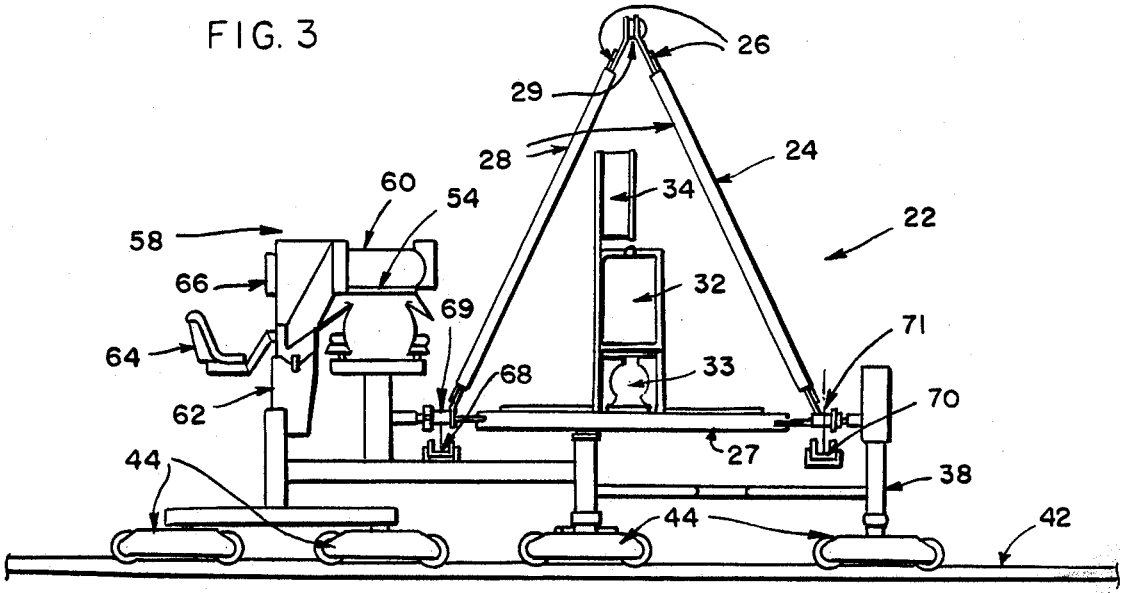
FIG. 3 is an end diagrammatic elevation of the concrete finishing machine depicted in FIGS. 1 and 2.

Referring to FIGS. 1–3, the concrete finishing machine 22 has connected cross members 27, truss members 28, and top chords 29 forming a framework 24. The framework 24 is mounted transversely over a paving area 20 to be paved with concrete and defines an axis 25 substantially perpendicular to the direction of framework travel.

The cross members 27, truss members 28 and top chords 29 are made of tubular aluminum. The cross members 27 and truss members 28 are bolted to spaced, parallel main supports 69, 71 that are substantially aligned with the framework axis 25. The truss members 28 and top chords 29 are bolted together at angle plates 26. The top chords 29 are arranged along a line aligned with the framework axis 25. An adjusting top chord 30 having an adjusting screw 31 to adjust the length is placed within the line of top chords 29 for adjusting the horizontal shape of the framework. As depicted in FIG. 3, the resulting cross section of the framework 24, parallel to the direction of framework travel, defines a substantially triangular shape.

Main supports 69, 71 are slidably secured to track engaging end sections 36, 38 to support the framework. The end sections 36 and 38 have rollers 44 adapted to travel on tracks 40 and 42, respectively, for moving the framework.

The cross members 27 and truss members 28 cooperate to define a section of the framework 24. The sections terminate at the cross members 27, and the top chords 29 connect adjacent sections. The concrete finishing machine 22 is designed to use one, two, three or more sections. By using a varying number of sections, the machine 22 can accommodate any width of paving area 20. As shown best on FIGS. 1 and 2, the framework sections may extend beyond the end sections 36, 38 so that the standard-sized sections will not interfere with locating the end sections 36, 38 adjacent to the sides of the paving area 20.

Figure 7:
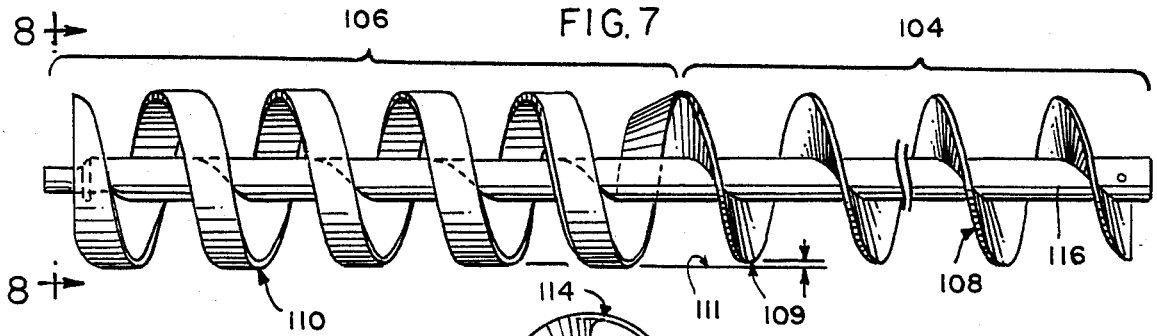
FIG. 7 is a side elevation detail of the auger unit.
Figure 8:
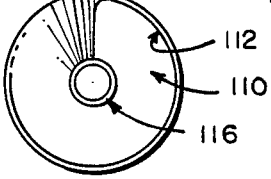
FIG. 8 is an end elevation of the auger unit depicted in FIG. 7.

A carriage 46 carries first and second auger units 48, 50 rotatably mounted on the carriage 46 in a parallel, spaced relationship. Referring to FIGS. 7 and 8, each auger unit has a leading portion 104 and a trailing portion 106 welded onto a shaft 116 aligned with the direction of framework travel. The leading portion 104 has steel helically arranged blades 108 for plowing excess concrete forward in the direction of framework travel. The trailing portion 106 has steel helically arranged blades 110 with a continuous steel band 114 welded to the outer edge 112 of the blades 110. The trailing portion 106 plows excess concrete forward to the leading portion 104, and the band 114 contacts the concrete at the desired grade to assist in finishing off the concrete.

As shown on FIG. 7, the blades 108 of the leading portion 104 have an outer edge 109 positioned in a fixed spaced relationship with the desired grade 111. This fixed spaced relationship is approximately ⅜-inches in order to leave a defined excess amount of concrete to be handled by the trailing portion 106 of the auger units, whereby the trailing portion will spread the excess concrete to fill voids that may exist.

The blades 108, 110 of the first auger unit 48 rotate in a clockwise direction and the blades 108, 110 of the second auger unit 50 rotate in a counterclockwise direction. The auger units maintain the same direction of rotation and will effectively plow excess concrete forward regardless of the direction of carriage 46 travel along the length of the framework 24.

Figure 4:
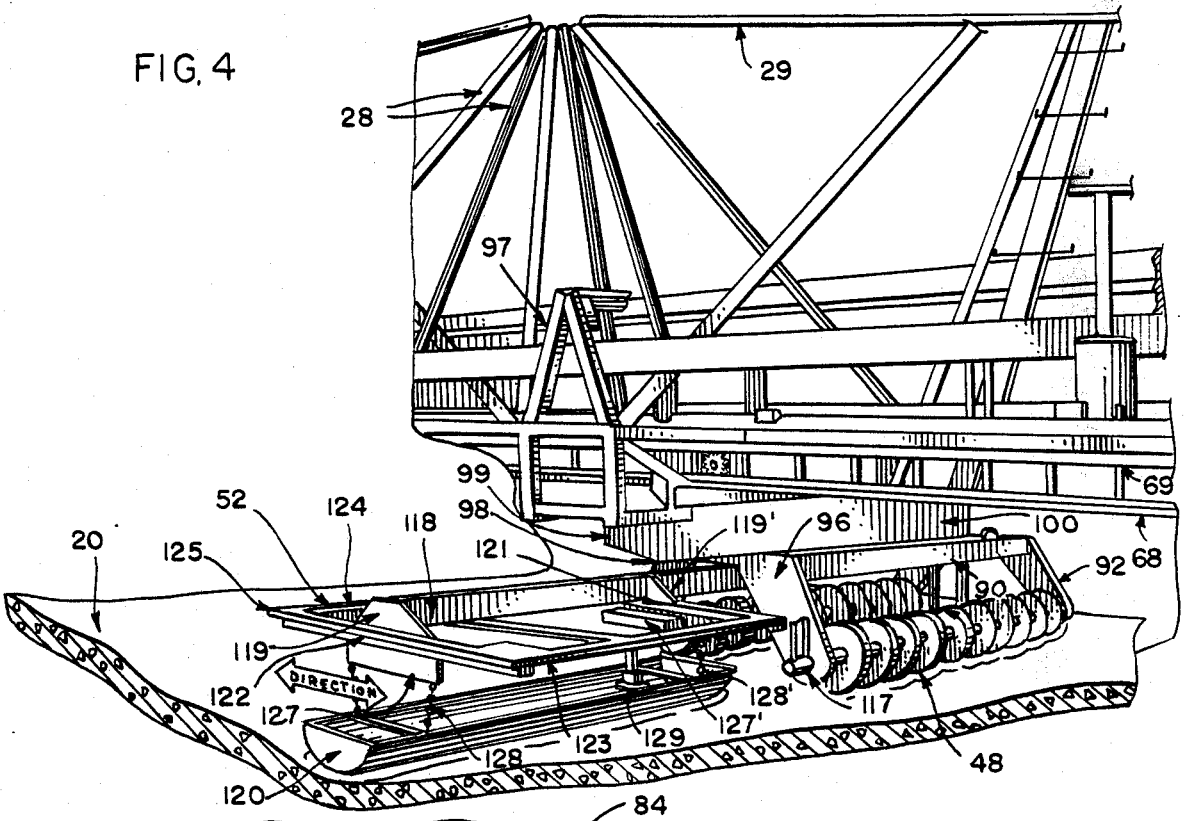
FIG. 4 is an enlarged perspective back view of the framework, carriage, auger unit and finishing member of the invention.

As best observed on FIG. 4, the carriage 46 also carries a finishing member 52 attached to the carriage 4 and having a bottom pan 120 with a substantially horizontal surface for engaging and finishing the concrete surface at a desired grade. The finishing member 52 is positioned adjacent to the trailing portion 106 of the auger units 48, 50 in a following arrangement relative to the direction of framework travel.

The bottom pan 120 of the finishing member 52 alternately moves between first and second positions. The bottom pan 120 is aligned along the axis defined by the first auger unit 48 when the first auger unit 48 reaches the edge of the paving area 20 that is located adjacent to end section 36. The bottom pan 120 is aligned along the axis defined by the second auger unit 50 when the second auger unit 50 reaches the edge of the paving area 20 that is located adjacent to end section 38. Thus, the bottom pan 120 moves along the length of the framework at a faster rate relative to the carriage 46 so that the bottom pan 120 is positioned at the edge of the paving area 20 whenever the carriage 46 reaches either side of the paving area 20.

A conveyor 54 is mounted on the end sections 36, 38 of the framework 24 and is aligned with the framework axis 25. A side discharge station 58 is movably mounted on the conveyor 54. As best depicted on FIGS. 9–13, the side discharge station 58 has a plow 60, discharge chute 62, operator platform 64 and control station 66. A swivel transfer 56 is also mounted on the conveyor 54.

Concrete is transferred by conveyor or other means well known in the art to the swivel transfer 56 which directs the concrete onto the conveyor 54. The concrete travels on the conveyor 54 until it reaches the plow 60 which directs the concrete into the discharge chute 62. The discharge chute 62 receives the concrete directed from the plow 60 and guides the concrete onto the paving area 20. The side discharge station 58 moves along the length of the conveyor 54 so that concrete can be deposited from the discharge chute 62 along the entire length of the paving area.

The operator of the concrete finishing machine sits on the operator platform 64 and controls all operations of the finishing machine from the control station 66. That is, the operator controls movement of the framework 24 along the paving area path, starts, stops and changes directions of the carriage 46, operates the auger units 48, 50 and finishing member 52, and operates the conveyor 54 and side discharge station 58 along the conveyor to deposit the concrete onto the paving area 20.

Referring to FIG. 3, a power unit 32, which is either an electric motor or gasoline engine, drives hydraulic pumps 33. An electric panel 34 for the power unit 32 is mounted nearby. In a manner well known in the art, the hydraulic pumps 33 circulate hydraulic fluid through hydraulic lines to the hydraulic motors that power all the movements of the concrete finishing machine 22. In other embodiments of the invention, electric motors and an electrical system could be used in lieu of the hydraulic motors and system. For clarity purposes, the hydraulic lines have been left off the Figures Generally, the hydraulic lines are run along the framework to the hydraulic motors in a noninterfering manner.

Carriage

Referring to FIGS. 3–6, the carriage 46 moves on spaced, parallel track members 68 and 70 attached to the main supports 69 and 71, respectively, through adjustable bolts 72. The bolts 72 are threadably engaged with nuts which can be used to adjust the track members 68, 70 to a desired height to match the contour of the desired grade of the paving area. The track members 68, 70 are aluminum extrusions having an upper chamber 73 for receiving and mounting the bolts 72, a lower chamber 74 for mounting a fixed chain 87, and top surfaces 75, 76 for receiving engaging wheels 82, 84.

Figure 5:
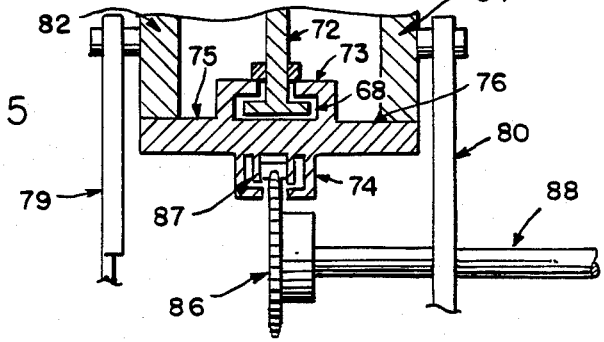
FIG. 5 is a detail of the connection of the carriage to the track member of the framework.
Figure 6:
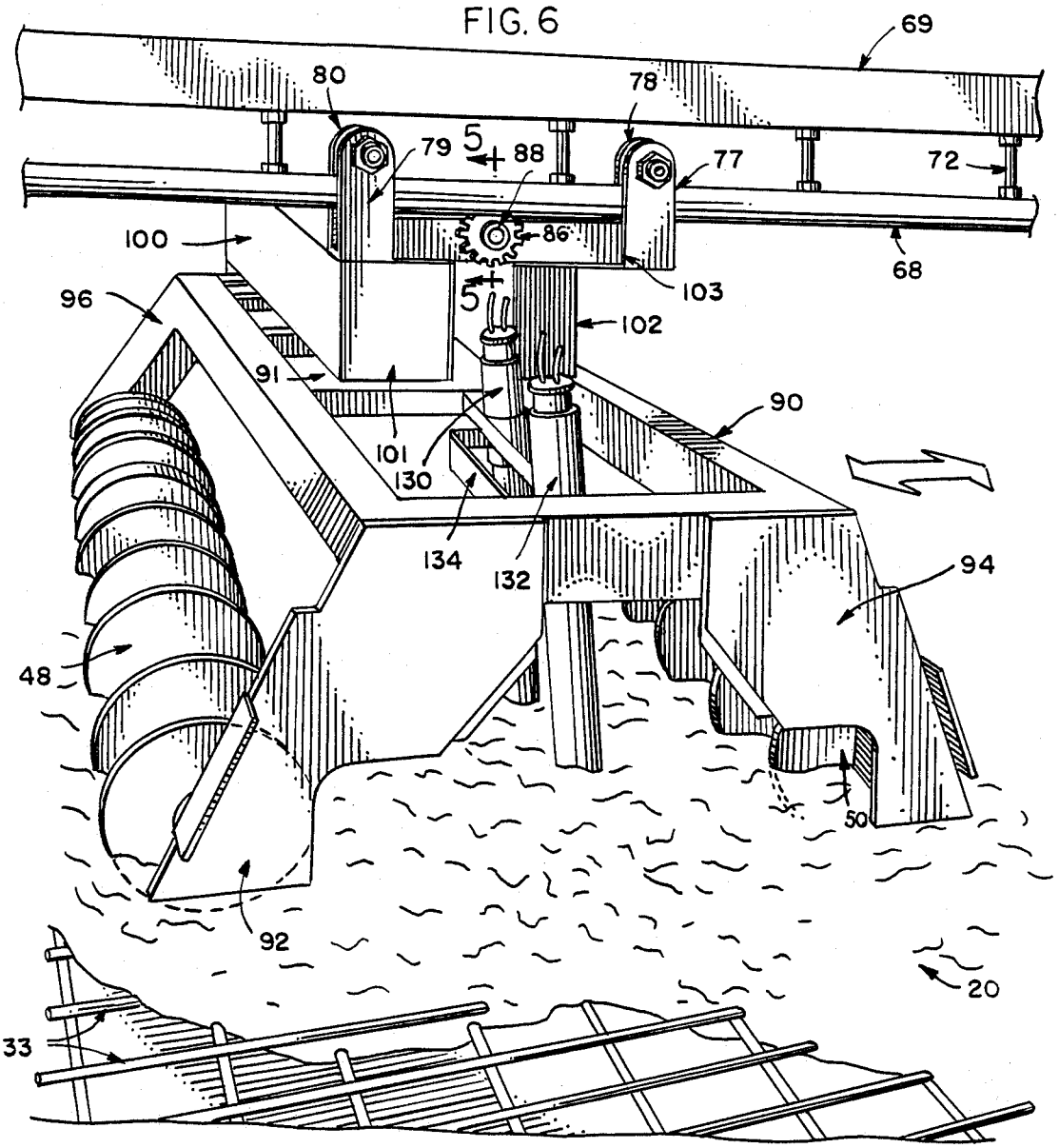
FIG. 6 is an enlarged perspective view of the leading end of the carriage and auger unit of the invention.

The carriage rides on four pairs of wheels engaging the track members 68, 70. Two pairs of wheels engage each track member as best depicted in FIGS. 5 and 6 for track member 68. Wheels 82 and 84 are rotatably connected to upstanding flanges 79 and 80, respectively. Likewise, wheels (not shown) are rotatably connected to upstanding flanges 77 and 78. The upstanding flanges 77, 78, 79 and 80 are secured to the wheel assembly support 103. The same construction in reversed orientation exists for the wheels, upstanding flanges and wheel assembly support associated with track member 70.

Referring to FIGS. 4 and 6, the wheel assembly supports 103 are connected to a carriage frame comprised of side panels 100 and 102 which are connected by rear and forward panels 99 and 101, respectively. FIG. 4 shows that a hydraulic line support 97 is attached to rear panel 99 for mounting hydraulic lines (not shown) running to the hydraulic motors of the carriage, auger units and finishing member. The hydraulic line support also maintains the hydraulic lines clear of the framework 24 so that the hydraulic lines can follow the carriage travel along the length of the framework.

A shaft 88 extends between the track members 68, 70 and is aligned substantially perpendicular to the framework axis 25. The shaft 88 is journalled in bearings on the wheel assembly supports 103. Sprockets 86 are attached to each end of the shaft 88. The teeth of the sprockets 86 engage the chain 87 secured to the track members 68, 70 as best depicted in FIG. 5 for track member 68.

A hydraulic motor, (not shown) suitably geared to drive a sprocket mounted on the shaft 88, is mounted to the carriage frame and reversibly drives the shaft 88 in a manner well known in the art. The shaft 88 then rotates the sprockets 86 to move the carriage through the coaction of the sprockets 86 engaging the fixed chain 87 and the wheels rolling on the track members 68, 70.

An auger support frame 90, depicted in FIG. 6, is secured to the carriage frame and generally located beneath the carriage frame. Cross brace 91 braces the frame 90, forward and rear side plates 92 and 96, respectively, are secured to the auger support frame 90 in a downward-extending, spaced, parallel relationship to support the first auger unit 48 that is journalled in bearings on the plates 92 and 96. The first auger unit is driven by a hydraulic motor 117 shown on FIG. 5.

In a similar manner, forward and rear side plates 94 and 98, respectively, are secured to the auger support frame 90 in a downward-extending, spaced, parallel relationship to support the second auger unit 50 that is journalled in bearings on the plates 94 and 96. The second auger unit 50 is driven by a hydraulic motor (not shown).

Referring to FIG. 6, two concrete vibrators 130, 132 driven by hydraulic motors are positioned intermediate the leading portions 104 of the first and second auger units 48, 50. This location of the vibrators 130, 132 provides improved consolidation of the concrete just prior to the finishing operation. The concrete vibrators are commercially available hydraulic concrete vibrators that are well known in the art, such as Wyco Tool Co. Series 419700.

The concrete vibrators 130, 132 are mounted on a retractable frame 134 that is alternately raised and lowered so that the concrete vibrators plunge in and out of the concrete as the carriage 46 moves along the length of the framework 24. This prevents the vibrators from shifting the steel reinforcing bars 133 or chipping the coating off the bars 133 that could result from the vibrators dragging over the reinforcing bars.

Referring to FIG. 15, a hydraulic motor (not shown) drives the retractable frame 134 in the plunging movement. The hydraulic motor is coupled to an overhung load adapter 143. The overhung load adapter is a heavy-duty bearing block designed to handle radial shaft loads greater than the drive motor. The hydraulic motor and load adapter 143 are mounted on bracket 142 that is secured to cross brace 91.

The adapter 143 inserts into a crank 141 for providing rotary motion. A bearing housing 145 connects the crank 141 to a connecting rod 140 that is connected by pin 144 to an output lever 139. The output lever is secured to a gimbal 137 that is rotatably connected to spaced brackets 138 by pin 145. The brackets 138 are secured to cross brace 91. Frame 134 is connected to gimbal 137. Clamps 135, 136, mounted on frame 134, hold the concrete vibrators 130, 132, respectfully, in a substantially vertical alignment.

Thus, the crank 141 turns the connecting rod 140 which, in turn, moves the output lever 139 in an alternately up and down direction. The lever 139 causes the gimbal 137 to rotate about pin 145 and alternately raise and lower the frame 134.

FIG. 4 best shows the finishing member 52. An arm 118 is cantilever mounted to the carriage frame. Mounting plates 119 and 119 connect a finisher support frame 125 to the arm 118 in a spaced, parallel relationship with the desired grade. The frame 125 is comprised of side frame members 123, 124 which are connected by forward and rear frame members 121, 122, respectively. Various brace members may optionally be included to strengthen the frame 125.

The bottom pan 120 is movably mounted on the finisher support frame 125 for movement in a direction substantially perpendicular to the framework axis 25. In a manner well known in the art, a gear and chain drive driven by a hydraulic motor (not shown), all mounted on the rear frame member 122, move a plate 127 from side to side along the length of member 122. A chain 128 connects the bottom pan 120 to the plate 127. Likewise in the same construction of a reversed orientation, a gear and chain drive driven by an hydraulic motor (not shown), all mounted on forward frame member 121, move a plate 127' from side to side along the length of member 121. A chain 128' connects the bottom pan 120 to the plate 127' plates 127 and 127' are arranged for synchronized movement.

The bottom pan 120 is generally an open-faced cylinder half having a flat bottom surface. In other embodiments of the invention, a drag plate or the like could be used in lieu of the bottom pan 120. A commercially available pan vibrator 129 is driven by a hydraulic motor to vibrate the bottom pa 120 in order to assist sealing of the concrete surface of the paving area.

Conveying Means

Referring to FIGS. 9–12, an elongated conveyor 54 is mounted on a frame having spaced, parallel support members 152, 154. The conveyor 54 has a continuous belt which, in a manner well known in the art, is powered by an electric or hydraulic motor and is connected to a drive pulley 55 of the conveyor.

The support members 152, 154 extend the length of conveyor 54 and are supported by the end sections 36, 38 of the framework 24. Cross braces (not shown) connect the support members 152, 154.

The support members 152, 154 support the conveyor frames 156, 158, respectively. The conveyor frames 156, 158 are aluminum extrusions that extend the length of the conveyor for mounting the conveyor components. A side discharge station 58 is movably mounted onto the conveyor frames 156, 158. As best shown on FIGS. 10–12, the conveyor frames 156, 158 have recessed tracks 157, 159, respectively, for receiving wheels 174, 175, 176, 177 rotatably connected to the side discharge station 58.

Figure 12:
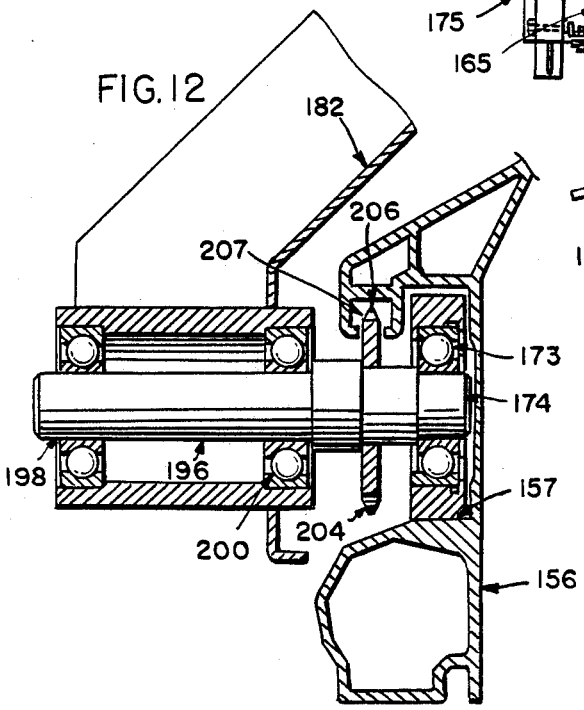
FIG. 12 is an enlarged detail of the connection of the side discharge station to the conveyor depicted in FIG. 10.

FIG. 12 shows the typical detail of the roller means connecting the side discharge station to the conveyor frame. The conveyor frame 156 has a recessed track 157 and a chain housing 206 for mounting a fixed chain 207. A wheel 174 having bearings 173 is journalled to the wheel shaft 196. A sprocket 204 is secured on the wheel shaft 196 and has teeth engaging the fixed chain 207. The wheel shaft 196 is journalled in bearings 200 on the housing 198 that is secured to the plow frame 182. The wheel shaft and sprocket are driven by a hydraulic motor 202 so that the teeth of the sprocket movably engages the fixed chain 207 to move the side discharge station 58 on the wheels. In another embodiment, an additional hydraulic motor could be mounted on the wheel shaft 178 of wheel 176 to provide added drive means for the side discharge station.

Figure 10:
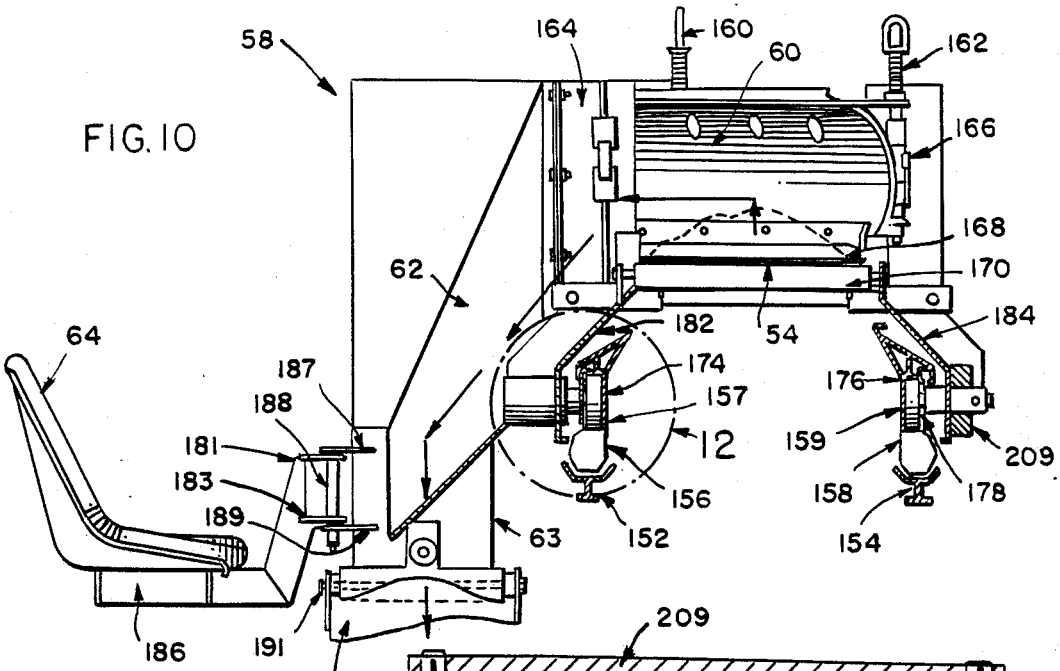
FIG. 10 is a side elevation detail of the side discharge station depicted in FIG. 9.
Figure 11:
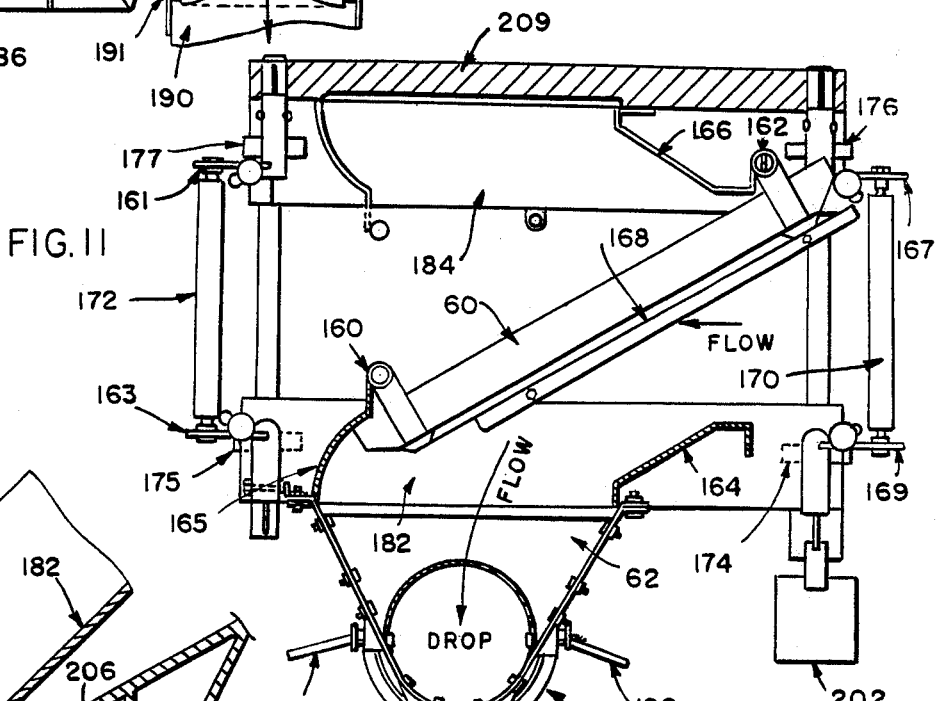
FIG. 11 is a top plan detail of the side discharge station depicted in FIG. 9.

Referring specifically to FIGS. 10 and 11, the side discharge station comprises spaced, parallel plow frames 182, 184 that are positioned on opposite sides of the conveyor. A plow 60 is adjustably attached to the plow frames 182, 184 by plow adjusting bolts 160, 162 connected to upstanding frame extensions 165, 166, respectively. Adjustment of the plow adjusting bolts 160, 162 raises or lowers the plow 60 to proper alignment. A slider bar 168 is secured to the lower portion of the plow for resting on the belt of the conveyor 54.

Horizontal roller 170 is rotatably attached to brackets 167, 169 which are secured to plow frames 184, 182, respectively. Horizontal roller 172 is rotatably attached to brackets 161, 163 which are secured to plow frames 184, 182, respectively. The rollers 170, 172 extend substantially perpendicular to the direction of the conveyor belt travel. The plow 60 is positioned intermediate the rollers 170, 172. The rollers 170, 172 are located underneath the continuous belt of the conveyor 54 so that the conveyor belt travels between the rollers 170, 172 and the slider bar 168.

As shown on FIG. 11, the concrete is directed by the plow 60 into the discharge chute 62. An upstanding guard frame 164, attached to the plow frame 182, further helps direct the concrete into the chute. The discharge chute 62 is affixed to the plow frame 182 and is braced by brace member 185 (depicted in FIG. 9) connecting the opposite side plow frame 184 to the chute 62. Various other brace members may optionally be included to strengthen the overall side discharge station 58.

The chute 62 converges from a substantially triangular shaped opening adjacent to the plow to a circular shaped opening at the bottom section 63 of the chute. A gimbal 191 connects a flexible portion 190 to the bottom section 63 so that the flexible portion 190 is free to incline in any direction. The flexible portion 190 extends downward from the bottom section 63 and has an opening positioned above the desired grade of the paving area. This is best depicted on FIG. 9.

An operator platform 64 in which the operator sits is mounted on a platform support 186. The support 186 is connected pivotally about a vertical axis to the bottom section 63 by pins 188. The pins 188 pivotally connect hinge brackets 181, 183 which are welded to the support 186, and the hinge brackets 187, 189, which are welded to bottom section 63. The operator can gain access to the operator platform 64 by climbing a ladder 150 that is secured to the platform support 186.

Figure 9:
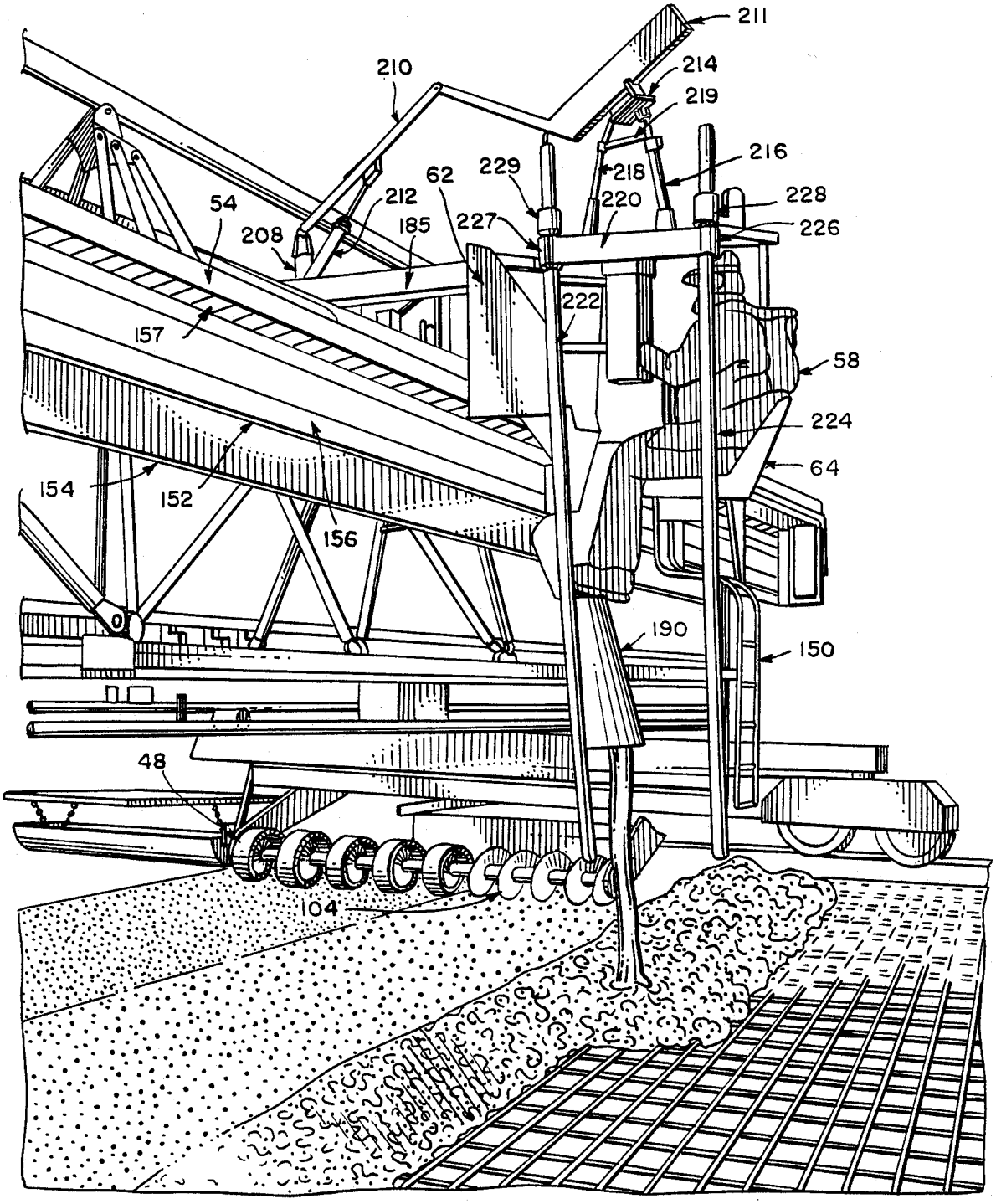
FIG. 9 is an enlarged perspective view of the conveyor and side discharge station of the invention.

Once seated in the platform 64, the operator can place his feet into stirrups 192, 194 mounted onto the sides of the flexible portion 190 as depicted on FIGS. 9 and 11. Thereby, the operator can direct the deposition of concrete onto the paving area 20 by his feet moving the flexible portion 190 of the discharge chute 62. As best depicted in FIG. 9, the leading portion 104 of the auger units 48, 50 and the discharge chute 64 are positioned for independent movement in a substantially parallel, fixed spaced relationship. Thus, the distance and time between the placing and finishing operations has been substantially decreased compared to prior art constructions. The number of laborers to place the concrete has also been significantly reduced since the single operator handles the majority of the concrete placing work.

Referring to FIG. 9, a retractable concrete vibrator assembly 211 is included with the movable side discharge station to assist the consolidation of concrete at the site of concrete placement onto the paving area. A vertical support 208 is secured to a vibrator mounting member 209 (depicted on FIGS. 10 and 11) which is connected to the plow frame 184 for movement along with the side discharge station. A main arm 210 is pivotally mounted to the vertical support 208.

A hinged plate 214 pivotally connects the main arm 210 to the upper ends of vertical members 216, 218 at bar 219. A horizontal cross arm 220 is secured to the lower ends of vertical members 216, 218. The cross arm 220 has first and second ends 226, 228 defining vertically extending ring openings for mounting vertically extending concrete vibrators 222, 224 to the cross arm 220 with clamps 228, 229. The vibrators 222, 224 are driven by hydraulic motors and are commercially available vibrators that are well known in the art such as Wyco Tool Co. Series 419700.

FIG. 9 shows the vibrator assembly 211 in the raised position whereby the vibrators are not placed in the concrete. A hydraulic cylinder 212 links the vertical support 208 to the main arm 210. The cylinder operates to raise and lower the main arm 210 and the vibrators 224, 224 connected thereto to position the vibrators in or out of the concrete placed onto the paving area.

In the preferred embodiment, two vibrator assemblies 211 are utilized. One assembly is mounted as shown on FIG. 9; another assembly (not shown) would be mounted on the side discharge station 58 s that its vertically extending vibrators are located substantially parallel to the vibrators 222, 224 and the operator platform 64 is positioned intermediate the vibrators of the two assemblies. With two vibrator assemblies 211, concrete vibrators are positioned on opposite sides of the discharge chute 62.

In other embodiments, one, three or more concrete vibrators may be mounted on each vibrator assembly 211.

End Sections

The end sections 36, 38 have rollers that run on parallel, spaced tracks 40, 42 whereby the framework axis 25 is substantially perpendicular to the direction of framework travel. In certain circumstances, such as non-parallel tracks 40, 42, the framework axis 25 may become skewed with respect to an axis perpendicular to the direction of framework travel.

Unless the track engaging end sections are adapted to accommodate the skewed movement of the framework axis 25, the framework may buckle and cause the carriage to move in a vertical direction. Such vertical carriage movement results in a deviation of the final grade from the desired grade of the concrete surface. FIGS. 13 and 14 illustrate how the end sections 36, 38 accommodate the skewed movement of the framework 24.

End section 38, depicted in FIG. 13, is generally symmetrical with end section 36 with respect to an axis defining the direction of framework travel. End section 38 is comprised of rollers, 256, 257, 258, 259, horizontal members 260, 262, telescoping legs 232, 250, 252, support leg 230 and alignment member 264, all substantially aligned in a plane parallel to the direction of framework travel.

End section 38 has rollers 256, 257, 258 and 259 travelling on track 42. Referring to roller 256 as an example, each roller has a housing 273 to which are journalled wheels 272, 274 for rolling on the track 42. Wheel sprockets 275, 277 are also fixed to the shaft carrying the wheels 272, 274. Sprocket chain 276 passes over the wheel sprockets 275, 277. A hydraulic motor (not shown) suitably geared to drive a sprocket that propels the chain 276 is mounted in the housing 273 and drives the roller 256 along the track 42.

The horizontal member 260 joins rollers 256 and 257. The upstanding telescoping leg 250 is secured to member 260 at a position intermediate the ends of member 260. The upstanding telescoping leg 252 is secured to the housing of roller 258. Horizontal member 262 joins telescoping legs 250 and 252. The upstanding support leg 230 is secured to member 262 and positioned intermediate legs 250 and 252. Support leg 230 has a channel member 231 mounted on its upper portion for supporting the conveying means described previously.

The upstanding telescoping leg 232 is secured to the housing of roller 259. The alignment member 264 joins telescoping legs 252 and 232. Alignment member comprises opposed horizontal arms 266, 268 attached to legs 252, 232, respectively, and a horizontal slide 270 that slidably connects the arms 266 and 268. Each arm has a roller rotatably mounted to the end of the arm that is opposite the telescoping leg to which the arm is connected. The rollers slidably engage a slide chamber of the slide 270 so that telescoping leg 232 can move relative to telescoping leg 252. Examples of the rollers, slide, arms and slide chamber of alignment member 264 are depicted on FIG. 14 as elements 280, 238, 240 and 278, respectively.

Telescoping legs 232, 250, 252 house jacks, which are standard units well known in the art, to raise or lower the end sections 36, 38 by turning cranks 233, 251, 253, respectively. The end sections could be raised to accommodate a super elevation adjustment for the desired grade of the paving area.

First and second slidable connections 234, 236 connect the support leg 230 and telescoping leg 232 to the main supports 69, 71, respectively, of the framework 24. Similarly, slidable connections connect the support legs of end section 36 to the main supports 69, 71.

Referring to FIGS. 13 and 14, the first slidable connection includes a horizontal slide 238 attached to main support 69 and an arm assembly 240 attached to the support leg 230. Track member 68 is connected to the slide 238 by the adjustable bolts 72. The arm assembly 240 has a roller 280 rotatably mounted to the end of the assembly that is opposite the leg 230 to which the assembly is attached. The roller 280 slidably engages a slide chamber 278 of the slide 238 so that the slide 238 can move relative to the support leg 230. A turnbuckle 242 having a handle 243 further connects the arm assembly 240 to the support leg 230 to assist in maintaining alignment of the framework. Operating in a similar manner, the second slidable connection includes slide 244, arm assembly 246 and turnbuckle 248.

Since the slidable connections permit the framework to move relative to the end sections and the alignment members permit the telescoping legs to move relative to each other, the concrete finishing machine of the present invention is free to rotate with respect to a fixed vertical axis. The selected fixed axis is preferably the support leg 230 that carries the end of the conveyor 54 on which concrete is loaded at the swivel transfer 56. Thus, skewed movement of the framework axis does not affect the desired grade of the paving area because the framework can rotate about the fixed vertical axis (support leg) to relieve stresses caused by the skewed movement.

While there has been set forth a preferred embodiment of this invention, it is to be understood that the concrete finishing machine of the invention is limited only by the following claims and their equivalents.

What is claimed is:

1. A concrete finishing machine comprising, in combination:

a framework mounted transversely over a paving area to be paved with concrete and defining an axis substantially perpendicular to the direction of framework travel, the framework having track engaging end sections to support the framework and means for moving the framework;

a carriage movably attached to the framework for movement along the axis defined by the framework, means for moving the carriage along the length of the framework;

at least one auger unit rotatably mounted on the carriage, the auger unit having leading and trailing ends and defining an axis substantially aligned with the direction of framework travel, means on the carriage for driving the auger unit to plow excess concrete forward in the direction of framework travel;

a finishing member attached to the carriage and having a substantially horizontal surface for engaging and finishing the concrete surface at a desired grade, the finishing member positioned adjacent to the trailing end of the auger unit in a following relationship relative to the direction of frame travel; and means for conveying concrete mounted on the framework and substantially aligned with the axis defined by the framework, the conveying having a side discharge station movably mounted thereon for directing concrete from the conveying means to the paving area along the length of the conveying means, the side discharge station having an operator platform for carrying an operator of the concrete finishing machine, a plow for directing the concrete from the conveying means, a discharge chute for receiving the concrete direct by the plow and guiding the concrete onto the paving area, said discharge chute being mounted on a gimbal secured to said side discharge station for controlling the position of said discharge chute from said operator platform, and means moving the side discharge station along the length of the conveying means.

2. The concrete finishing machine of claim 1 wherein the leading end of the auger unit and the discharge chute are positioned for independent movement in a substantially parallel, fixed spaced relationship, the discharge chute located ahead of the leading end of the auger unit in relationship to the direction of the framework travel.

3. The concrete finishing machine of claim 1 which includes stirrups mounted on opposite sides of the discharge chute for placement of the feet of the operator whereby the operator can direct the deposition of concrete onto the paving area by his feet moving the discharge chute.

4. The concrete finishing machine of claim 1 wherein the operator platform includes a control panel for centrally controlling the operation of means for moving the framework, means for moving the carriage, means for driving the auger unit, means for conveying the means for moving the side discharge station.

5. The concrete finishing machine of claim 1 wherein the conveying means includes an elongated conveyor mounted on a frame, the frame having spaced parallel support members extending the length of the conveyor and supported by the track engaging end sections of the concrete finishing machine, the side discharge station having roller means engaging the support members, the roller means mounted on a shaft journalled to the side discharge station, the shaft rotatably driven by drive means for moving the side discharge station along the length of the conveyor.

6. The concrete finishing machine of claim 1 including at least one retractable concrete vibrator mounted on the side discharge station and means for driving the vibrator, the vibrator retractably extending into the concrete placed from the discharge chute to assist the consolidation of the concrete.

7. The concrete finishing machine of claim 2 wherein said leading end has a helically arranged blade for plowing excess concrete forward in the direction of framework travel, wherein said trailing end has a helically arranged blade with an outer edge, a continuous band attached to the outer edge for contacting the concrete surface at a desired grade, the trailing portion adapted to plow excess concrete forward to the leading portion and to assist in finishing off the concrete.

8. The concrete finishing machine of claim 7 having first and second auger units in a substantially parallel spaced relationship, the helically arranged blades of the first auger unit rotating in a clockwise direction and the helically arranged blades of the second auger unit rotating in a counterclockwise direction.

9. The concrete finishing machine of claim 8 including at least one retractable concrete vibrator and means for driving the vibrator mounted on the carriage, the vibrator positioned intermediate the leading portions of the first and second auger units and retractably extending into the concrete to assist the consolidation of the concrete.

10. The concrete finishing machine of claim 9 wherein the vibrator includes means for plunging the vibrators alternately in and out of the concrete as the carriage moves along the length of the framework.

11. The concrete finishing machine of claim 8 wherein the finishing member has drive means attached thereto for alternately moving the finishing member between first and second positions, the finishing member substantially aligned along the axis defined by the first auger unit in the first position, the finishing member substantially aligned along the axis defined by the second auger unit in the second position.

12. The concrete finishing machine of claim 7 wherein the helically arranged blades of the leading and trailing portions of the auger unit are mounted on one substantially horizontal shaft journalled on the carriage, the blades of the leading portion having an outer edge positioned in a fixed spaced relationship with the desired grade for leaving a defined excess amount of concrete to be handled by the trailing portion of the auger unit, whereby the trailing portion will spread the excess concrete to fill voids and plow the remaining excess concrete forward toward the leading portion.

13. The concrete finishing machine of claim 12 wherein the fixed spaced relationship between the outer edge of the blades of the leading portion and the desired grade is at least ⅜-inches.

14. The concrete finishing machine of claim 7 wherein the means for moving the carriage includes spaced parallel track members attached to the framework, the track members substantially aligned with the framework axis and extending the length of the framework, a fixed chain mounted along the length of each of the track members, roller means engaging each of the track members and connecting the carriage to the track members, a shaft extending between the track members and aligned substantially perpendicular to the framework axis, the shaft journalled to the carriage and having fixed sprockets engaging the chains of each track member, the shaft rotatably driven by drive means for moving the carriage through the coaction of the sprocket and roller means along the length of the track members.

15. A concrete finishing machine comprising, in combination:

connected truss members forming a framework, the framework mounted transversely over a paving area to be paved with concrete and defining an axis substantially perpendicular to the direction of framework travel, the framework having a cross section substantially parallel to the direction of framework travel, the cross section defining a substantially triangular shape, the framework further having track engaging end sections to support the framework;

the track engaging end sections having at least two legs and rollers adapted to travel on a track for moving the framework in the direction of framework travel, means for moving the rollers mounted on the end sections, the end sections having adjustment means to maintain a desired grade during skewed movement of the framework axis relative to an axis perpendicular to the direction of framework travel;

a carriage movably attached to the framework for movement along the axis defined by the framework, means for moving the carriage along the length of the conveyor;

at least one auger unit rotatably mounted on the carriage, the auger unit having leading and trailing ends and defining an axis substantially aligned with the direction of framework travel, means on the carriage for driving the auger unit to plow excess concrete forward in the direction of framework travel;

a finishing member attached to the carriage and having a substantially horizontal surface for engaging and finishing the concrete surface at a desired grade, the finishing member positioned adjacent to the trailing end of the auger unit in a following relationship relative to the direction of frame travel; and means for conveying concrete mounted on the framework and substantially aligned with the axis defined by the framework, the conveying means having a side discharge station movably mounted thereon for directing concrete from the conveying means to the paving area along the length of the conveying means, the side discharge station having an operator platform for carrying an operator of the concrete finishing machine, a plow for directing the concrete from the conveying means, a discharge chute for receiving the concrete directed by the plow and guiding the concrete onto the paving area, said discharge chute being mounted on a gimbal secured to said side discharge station for controlling the position of the discharge chute from said operator platform and means for moving the side discharge station along the length of the conveying means.

16. The concrete finishing machine of claim 15 wherein the track engaging end sections have means for raising and lowering the end sections.

17. The concrete finishing machine of claim 15 wherein the adjustment means of each end section includes first and second slidable connections connecting the end section to the framework and an alignment member mounted on the end section intermediate the first and second slidable connections, each slidable connection including a slide attached to the framework and an arm assembly attached to the end section, the arm assembly having roller means for slidably engaging the slide, the alignment member connecting the legs of the end section and having arms attached to the legs and a slide member connecting the arms, the arms having roller means for slidably engaging the slide member.

18. The concrete finishing machine of claim 17 including turnbuckles connecting each arm assembly to the end section.

19. A concrete finishing machine comprising, in combination:

connected truss members forming a framework, the framework mounted transversely over a paving area to be paved with concrete and defining an axis substantially perpendicular to the direction of framework travel, the framework having a cross section substantially parallel to the direction of framework travel, the cross section defining a substantially triangular shape, the framework further having track engaging end sections to support the framework;

the track engaging end sections having at least two legs and rollers adapted to travel on a track for moving the framework in the direction of framework travel, means for moving the rollers mounted on the end sections;

first and second slidable connections connecting the end section to the framework and an alignment member mounted on the end section for accommodating skewed movement of the framework axis relative to an axis perpendicular to the direction of framework travel, each slidable connection including a slide attached to the framework and an arm assembly attached to the end section, the arm assembly having roller means for slidably engaging the slide, the alignment member positioned intermediate the first and second slidable connections and connecting the legs of the end sections, the alignment member further having arms attached to the legs and a slide member attaching the arms, the arms having roller means for slidably engaging the slide member;

a carriage movably attached to the framework for movement along the axis defined by the framework, means for moving the carriage along the length of the framework;

first and second auger units rotatably mounted on the carriage in a substantially parallel spaced relationship, each auger unit having leading and trailing portions on an axis substantially aligned with the direction of framework travel, the leading portion having a helically arranged blade for plowing excess concrete forward in the direction of framework travel, the trailing portion having a helically arranged blade with an outer edge, a continuous band attached to the outer edge for contacting the concrete surface at a desired grade, the trailing portion adapted to plow excess concrete forward to the leading portion and to assist in finishing off the concrete, the helically arranged blades of the first auger unit rotating in a clockwise direction and the helically arranged blades of the second auger unit rotating in a counterclockwise direction;

a finishing member attached to the carriage and having a substantially horizontal surface for engaging and finishing the concrete surface at a desired grade, the finishing member positioned adjacent to the trailing portion of the auger units in a following relationship relative to the direction of framework travel, the finishing member further having drive means attached thereto for alternately moving the finishing member between first and second positions, the finishing member substantially aligned along the axis defined by the first auger unit in the first position, the finishing member substantially aligned along the axis defined by the second auger unit in the second position; and means for conveying concrete mounted on the framework and substantially aligned with the axis defined by the framework, the conveying means having a side discharge station movably mounted thereon for directing concrete from the conveying means to the paving area along the length of the conveying means, the side discharge station having a plow for directing the concrete from the conveying means, a discharge chute for receiving the concrete directed by the plow and guiding the concrete onto the paving area, and means for moving the side discharge station along the length of the conveying means.

20. The concrete finishing machine of claim 19 wherein the forward portions of the auger units and the discharge chute are positioned for independent movement in a substantially parallel, fixed spaced relationship, the discharge chute located ahead of the leading portions of the auger units in relationship to the direction of the framework travel.

21. The concrete finishing machine of claim 19 wherein the side discharge station includes an operator platform for carrying an operator of the concrete finishing machine, the discharge chute having a flexible portion with sides, stirrups mounted on opposite sides of the flexible portion for placement of the feet of the operator whereby the operator can direct the deposition of concrete onto the paving area by his feet moving the flexible portion of the discharge chute.

22. The concrete finishing machine of claim 19 wherein the helically arranged blades of the leading and trailing portions of each auger unit are mounted on one substantially horizontal shaft journalled on the carriage, the blades of the leading portion having an outer edge positioned in a fixed spaced relationship with the desired grade for leaving a defined excess amount of concrete to be handled by the trailing portion of the auger unit, whereby the trailing portion will spread the excess concrete to fill voids and plow the remaining excess concrete forward toward the leading portion.

23. The concrete finishing machine of claim 22 wherein the fixed spaced relationship between the outer edge of the blades of the leading portion and the desired grade is at least ⅜-inches.

24. The concrete finishing machine of claim 19 wherein the means for moving the carriage includes spaced parallel track members attached to the framework, the track members substantially aligned with the framework axis and extending the length of the framework, a fixed chain mounted along the length of each of the track members, roller means engaging each of the track members and connecting the carriage to the track members, a shaft extending between the track members and aligned substantially perpendicular to the framework axis, the shaft journalled to the carriage and having fixed sprockets engaging the chains of each track member, the shaft rotatably driven by drive means for moving the carriage through the coaction of the sprocket and roller means along the length of the track members.

25. The concrete finishing machine of claim 19 including at least one retractable concrete vibrator and means for driving the vibrator mounted on the carriage, the vibrator positioned intermediate the leading portions of the first and second auger units and retractably extending into the concrete to assist the consolidation of the concrete.

26. The concrete finishing machine of claim 25 wherein the vibrator includes means for plunging the vibrators alternately in and out of the concrete as the carriage moves along the length of the framework.

* * * * *